US006163300A

United States Patent [19]

Ishikawa et al.

[11] Patent Number: 6,163,300

[45] **Date of Patent: *Dec. 19, 2000**

[54] MULTI-BAND ANTENNA SUITABLE FOR USE IN A MOBILE RADIO DEVICE

[75] Inventors: Shigekazu Ishikawa; Makoto Teshima, both of Sendai; Masashi Ikeda, Tokyo; Kazuo Minegishi, Sendai, all of Japan

[73] Assignee: Tokin Corporation, Miyagi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/121,422

[22] Filed: Jul. 23, 1998

[30] Foreign Application Priority Data

| | | | |
|---|---|---|---|
| Aug. 7, 1997 | [JP] | Japan | 9-212867 |
| Dec. 15, 1997 | [JP] | Japan | 9-345304 |
| Mar. 27, 1998 | [JP] | Japan | 10-081211 |
| Apr. 21, 1998 | [JP] | Japan | 10-110783 |

[51] Int. Cl.[7] ..... H01Q 1/24

[52] U.S. Cl. ..... 343/702; 343/895; 343/901

[58] Field of Search ..... 343/700 MS, 702, 343/715, 749, 750, 895, 900, 901

[56] References Cited

U.S. PATENT DOCUMENTS

| | | | |
|---|---|---|---|
| 1,783,025 | 11/1930 | Meissner | 343/749 |
| 2,648,771 | 8/1953 | Cork | 343/749 |
| 4,490,727 | 12/1984 | Kowols | 343/895 |
| 4,924,238 | 5/1990 | Ploussios | 343/894 |
| 5,134,419 | 7/1992 | Egashira | 343/722 |
| 5,412,392 | 5/1995 | Tsunekawa | 343/702 |
| 5,438,339 | 8/1995 | Itoh et al. | 343/702 |
| 5,446,469 | 8/1995 | Makino | 343/702 |
| 5,479,178 | 12/1995 | Ha | 343/702 |
| 5,661,495 | 8/1997 | Saldell | 343/702 |
| 5,734,352 | 3/1998 | Seward et al. | 343/895 |
| 5,859,617 | 1/1999 | Fujikawa | 343/702 |

*Primary Examiner*—Tan Ho

*Attorney, Agent, or Firm*—Frishauf, Holtz, Goodman, Langer & Chick, P.C.

[57] ABSTRACT

In a multi-band antenna (10) being provided with an antenna element having an LC parallel resonance circuit (3) and a first and a second radiation element (1,2) connected to opposite ends of the LC parallel resonance circuit, the LC parallel resonance circuit is constituted by self-resonance of an inductor itself. A telescopic whip antenna may be constituted by combining a small-size antenna and a whip antenna which is receivable in a radio device casing and expandable.

35 Claims, 17 Drawing Sheets

MULTI-BAND ANTENNA SUITABLE FOR USE IN A MOBILE RADIO DEVICE

BACKGROUND OF THE INVENTION

The present invention relates to an antenna for use in a mobile radio device etc. and, in particular, to a multi-band antenna which can carry out transmission and reception at a plurality of mutually different frequency bands.

Recently, there have been those regions and countries wherein a plurality of portable telephone systems using different frequency bands are available. For example, in Japan, the PDC system uses 800 MHz and 1.5 GHz bands, while the PHS system uses a 1.9 GHz band. On the other hand, 800 MHz and 1.9 GHz bands are used in U.S.A., while 900 MHz and 1.8 GHz bands are used in Europe.

Following the recent remarkable spread of portable terminals, there has been caused congestion with respect to a certain frequency band. In view of this, there have been such requests that each portable terminal can carry out transmission and reception at a plurality of frequency bands. According to the requests, when a first frequency band allocated initially is crowded or in case of a region where such a first frequency band is not available, transmission and reception can be performed using a second frequency band allocated secondarily.

In general, when a radio device is used at different frequency bands, a plurality of antennas are used. As a typical example of such a radio device, an FM/AM radio set can be cited. In contrast, there has been a trap antenna which is so arranged as to be used at different frequency bands. The trap antennas have been widely used in amateur radio devices as multi-band antennas.

For example, JP-A-5-121924 discloses a conventional trap antenna. The disclosed trap antenna comprises a linear antenna element and a trap circuit having a coil and a capacitor.

However, there has been a problem that the number of parts and the number of manufacturing processes required for the conventional trap antenna are both large. Further, when the conventional trap antenna is externally attached to the radio device in an exposed fashion, it is defective in strength such that the coil and the capacitor tend to be damaged when subjected to a shock etc. This raises a serious problem with respect to a portable terminal which is supposed to be carried. Further, since the conventional trap antenna can not be drawn out to the exterior of the radio device and has only a small gain, a problem may be raised that, in particular, transmission characteristics can not be ensured upon transmission from the radio device. Moreover, since a structure of the conventional trap antenna is complicated, the size reduction thereof is difficult to achieve. There have been further problems that dispersion in resonance frequency of the conventional trap antennas is increased depending on manufacturing processes, the productivity thereof is low and it is relatively heavy.

Therefore, the conventional trap antenna can not be said to be suitable for use in a portable terminal for the portable telephone system.

SUMMARY OF THE INVENTION

It is therefore an object of the present invention to provide a multi-band antenna suitable for use in a portable terminal for a portable telephone system.

It is another object of the present invention to constitute a trap circuit which is reducible in number of parts, easy to manufacture and small-sized, so as to provide a small-size multi-band antenna which is cheap but excellent in transmission characteristic, which can improve reliability against a shock etc. and which can carry out transmission and reception at different frequency bands.

It is still another object of the present invention to provide a telescopic multi-band antenna which can always achieve an excellent multi-band characteristic.

It is yet another object of the present invention to provide a small-size multi-band helical antenna which can carry out transmission and reception at different frequency bands.

It is further object of the present invention to provide a telescopic whip antenna whose dispersion in resonance frequency is small, whose productivity is high and which is provided with a small-weight and small-size antenna.

According to an aspect of the present invention, there is provided a multi-band antenna comprising an antenna element having an LC parallel resonance circuit and a first and a second radiation element connected to opposite ends of the LC parallel resonance circuit, wherein the LC parallel resonance circuit is constituted by self-resonance of an inductor itself.

According to another aspect of the present invention, there is provided a telescopic multi-band whip antenna comprising a small-size antenna and a whip antenna which is receivable in a radio device casing and expandable, wherein the small-size antenna is located outside the radio device casing, the whip antenna being slidable relative to the small-size antenna, each of the small-size antenna and the whip antenna both having multi-band characteristics so that the multi-band characteristics are obtained both upon putting back and expansion of the whip antenna. According to still another aspect of the present invention, there is provided a multi-band helical antenna comprising a plurality of helical coils, at least one helical guide around which the plurality of helical coils are wound, and a conductive holder holding the at least one helical guide, wherein power is fed from the conductive holder to at least one of the plurality of helical coils so as to obtain a plurality of resonance frequencies.

According to yet another aspect of the present invention, there is provided a multi-band helical antenna comprising a plurality of helical coils having the same diameter and the different numbers of turns, a helical guide around which the plurality of helical coils are wound, an insulating portion being a dielectric and provided on a surface of the helical guide to separate the plurality of helical coils from each other, and a conductive holder holding the helical guide, power being fed from the holder to one of the plurality of helical coils and further fed to the other helical coil through capacitive coupling so as to obtain a plurality of resonance frequencies.

According to further aspect of the present invention, there is provided a telescopic whip antenna comprising a rod antenna which is receivable in a casing and expandable, and a small-size antenna provided at an upper portion of the rod antenna, wherein power is fed to the rod antenna upon expansion and to the small-size antenna upon putting back, the small-size antenna being substantially in the form of a board made of an insulating material and formed thereon with an electrode pattern and uses a resonance frequency based on a dielectric constant of the board and the electrode pattern.

DESCRIPTION OF THE PREFERRED EMBODIMENTS

Now, multi-band antennas according to first to eighteenth preferred embodiments of the present invention will be described with reference to the accompanying drawings.

Figure 1:
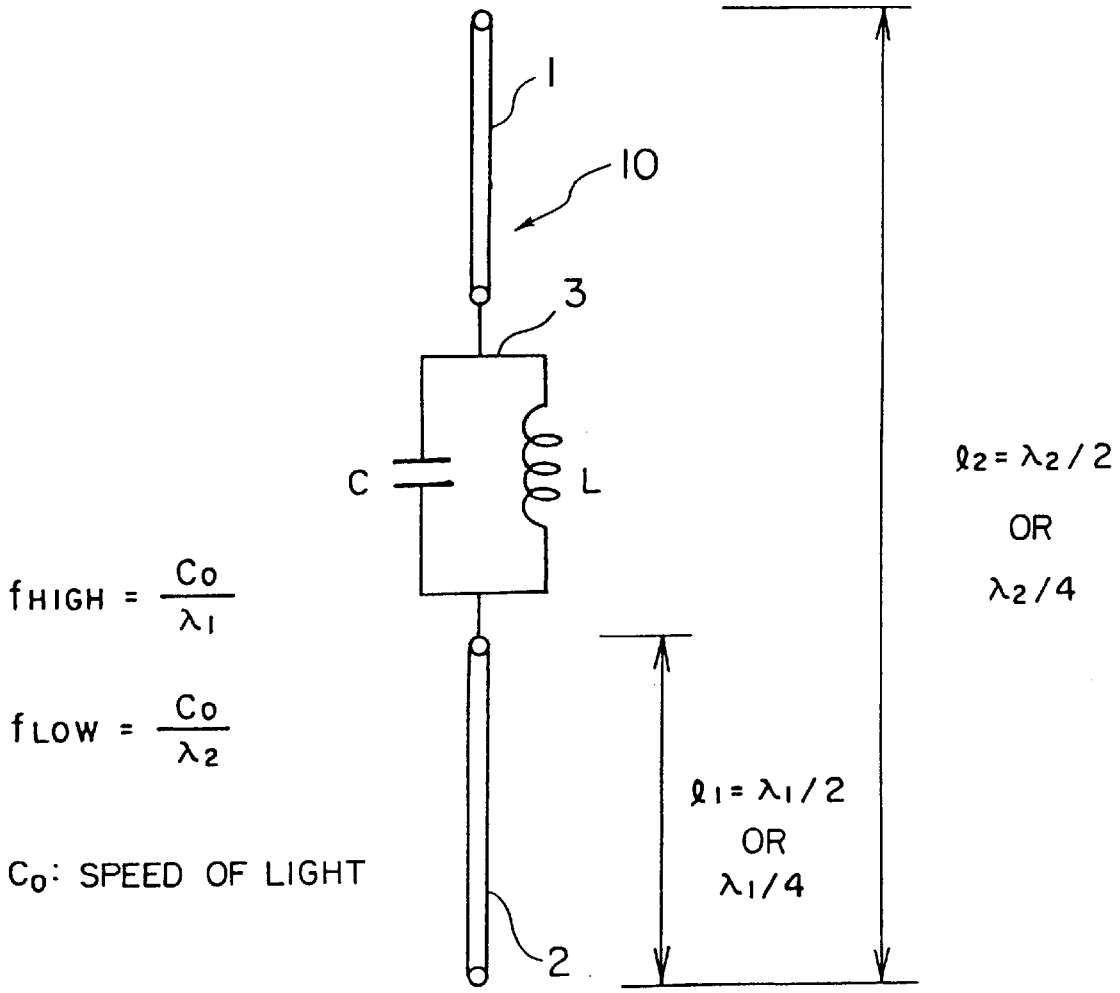
FIG. 1 is a diagram showing a schematic structure of a multi-band antenna according to a first preferred embodiment of the present invention.

Referring first to FIG. 1, a multi-band antenna 10 according to the first preferred embodiment of the present invention will be described, wherein the multi-band antenna 10 corresponds to two allocated frequency bands, that is, 800 MHz and 1.9 GHz bands.

The multi-band antenna 10 comprises a linear element 1 on an open end side as a first radiation element, a linear element 2 on a telephone side as a second radiation element, and a trap circuit connected therebetween. Each of the linear elements 1 and 2 is made of a superelastic alloy in the form of a Ti—Ni alloy.

In the multi-band antenna 10, the trap circuit is achieved by self-resonance of an inductor. With respect to the self-resonance of the inductor, a chip laminated inductance element (hereinafter referred to as "chip inductor") 3 is used as a surface mounting (SMD) type self-resonance inductor in FIG. 1. The chip inductor 3 is of a 1005 size (1.0 mm×0.5 mm).

Figure 2:
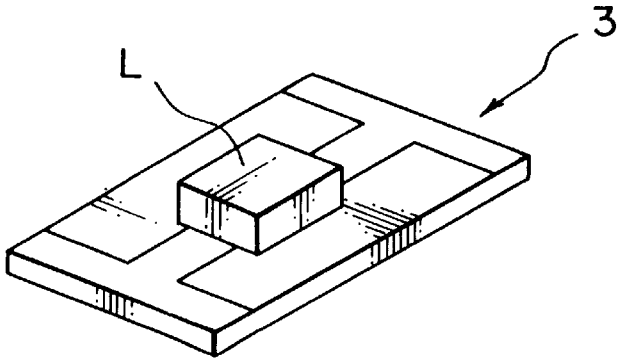
FIG. 2 is a perspective view showing an example of a chip inductor used in the multi-band antenna shown in FIG. 1.

As shown in FIG. 2, the trap circuit is constituted by mounting only the chip inductor 3 on a substrate. Accordingly, the trap circuit can be obtained which does not require a capacitance element and is small in size, low in price and small in number of assembling steps.

In the multi-band antenna 10, a length of each of the linear elements 1 and 2 may be $\lambda/2$, $\lambda/4$ or $\lambda/8$, while it is $\lambda/4$ in an explanation given below.

Figure 3:
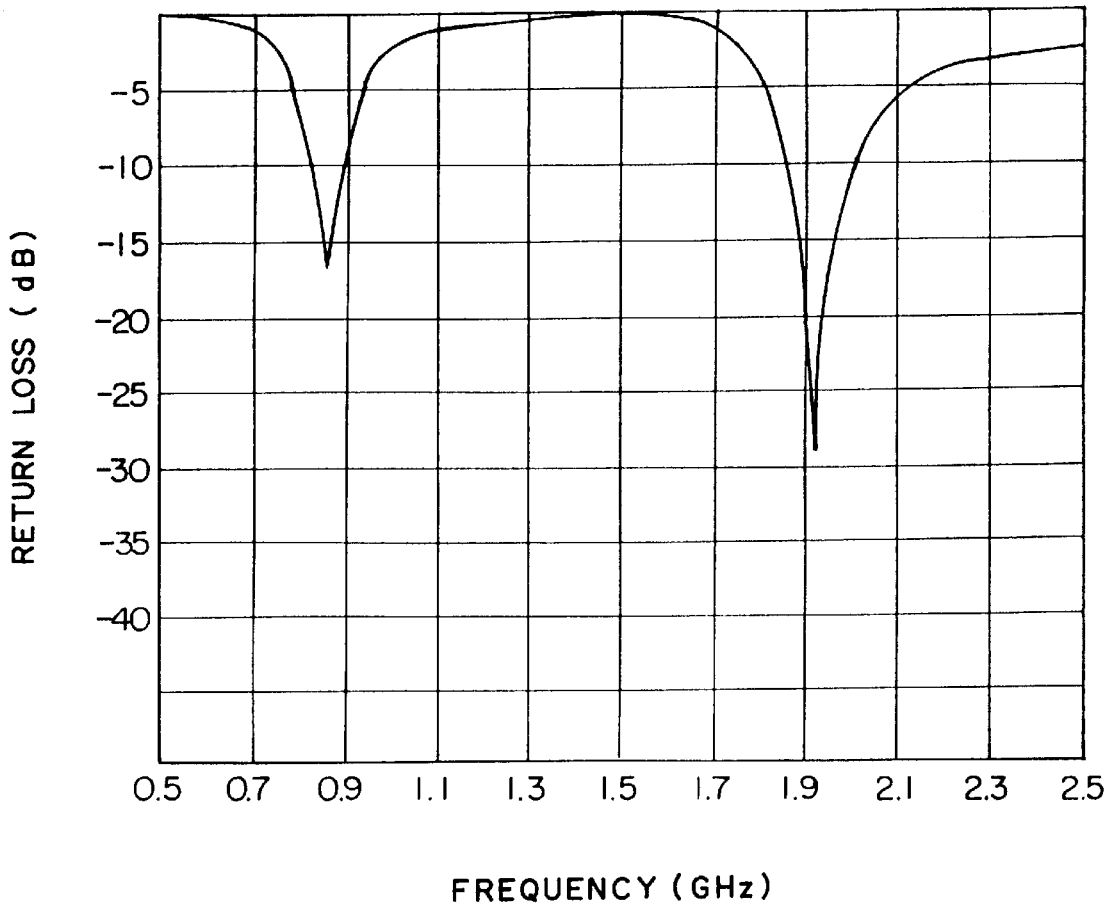
FIG. 3 is a diagram showing a characteristic example of the multi-band antenna shown in FIG. 1.

In FIG. 1, a length of the linear element 1 on the open end side was set to 3.9 cm, a length of the linear element 2 on the telephone side was set to 2.9 cm, each of the linear elements 1 and 2 had a diameter of 0.8 mm and was made of the Ni—Ti alloy, a value of the chip inductor 3 was set to 39 nH, and a stray capacitance of the inductor was 0.18 pF. As a result, a multi-band characteristic as shown in FIG. 3 was obtained, wherein the characteristic was shown in terms of a return loss characteristic observed by a 50 Ω network analyzer.

Figure 4:
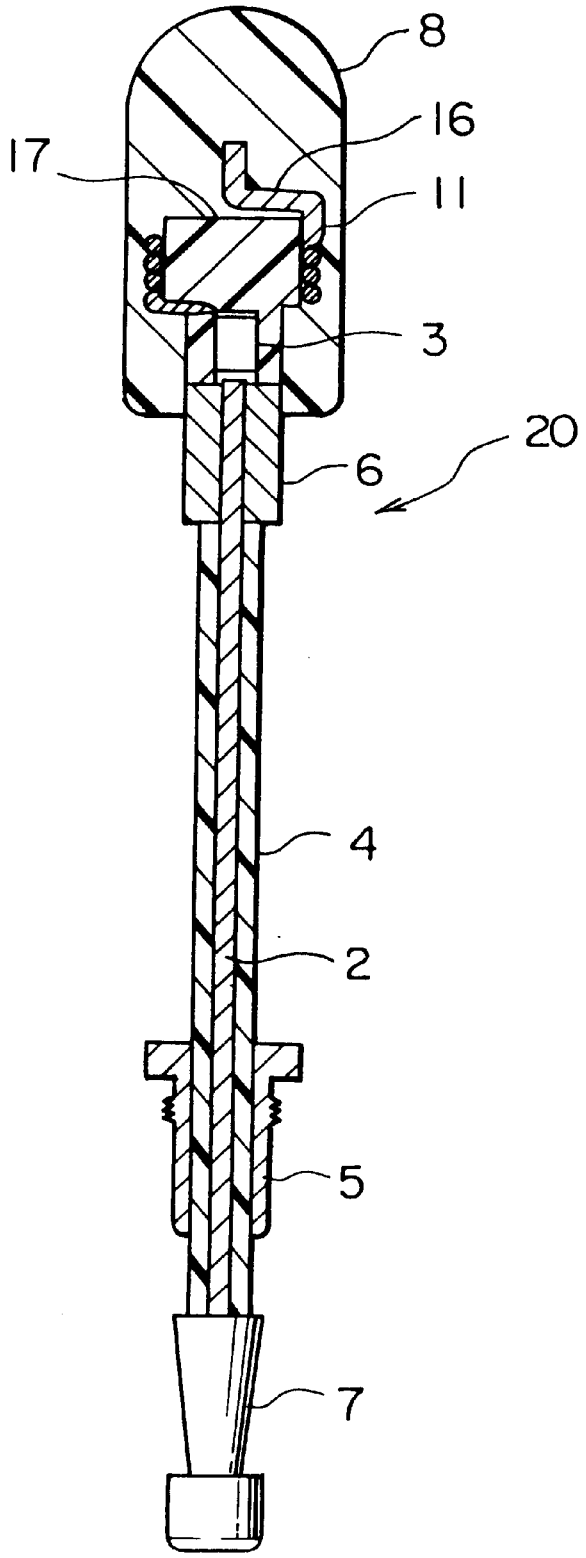
FIG. 4 is a sectional view showing a multi-band antenna according to a second preferred embodiment of the present invention.

Referring now to FIG. 4, a multi-band antenna 20 according to the second preferred embodiment of the present invention will be described. In FIG. 4, the linear element 1 on the open end side, being the first radiation element, in the multi-band antenna 10 shown in FIG. 1 is replaced with a helical element 11. In the multi-band antenna 20, the linear element 2 on the telephone side, being the second radiation element, in the multi-band antenna 10 is used as it is, and a chip inductor 3 having the same value as that in the multi-band antenna 10 is used for a trap circuit.

Specifically, the helical element 11 comprises a helical coil 16 and a helical guide 17 around which the helical coil 16 is wound. The chip inductor 3 is received in the helical coil guide 17 and has one end connected to one end of the helical coil 16. To the other end of the chip inductor 3 is connected one end of the linear element 2 being the second radiation element. A sleeve 6 made of a conductive material is provided around the linear element 2 at the foregoing one end thereof so as to reach the helical guide 17. The helical element 11 and one end of the sleeve 6 are covered through molding with flexible insulating resin such as polymer or elastomer so as to form a mold portion 8. A tube 4 made of a flexible insulating material such as polymer or elastomer is provided through molding to cover the linear element 2 from the other end of the sleeve 6 to the other end of the linear element 2. A holder 5 for attachment to a portable telephone (not shown) is mounted on the tube 4 so as to be slidable along an axis of the linear element 2. The holder 5 is provided near the other end of the linear element 2, and the other end of the linear element 2 is terminated by a stopper 7. The helical element 11 has an outer diameter of 2.8 mm and a length of 18 mm, and the helical coil 16 is made of a wire having a diameter of 0.4 mm and has four turns. The multi-band antenna 20 in this embodiment achieves a multi-band characteristic similar to that of the multi-band antenna 10 shown in FIG. 1.

Figure 5:
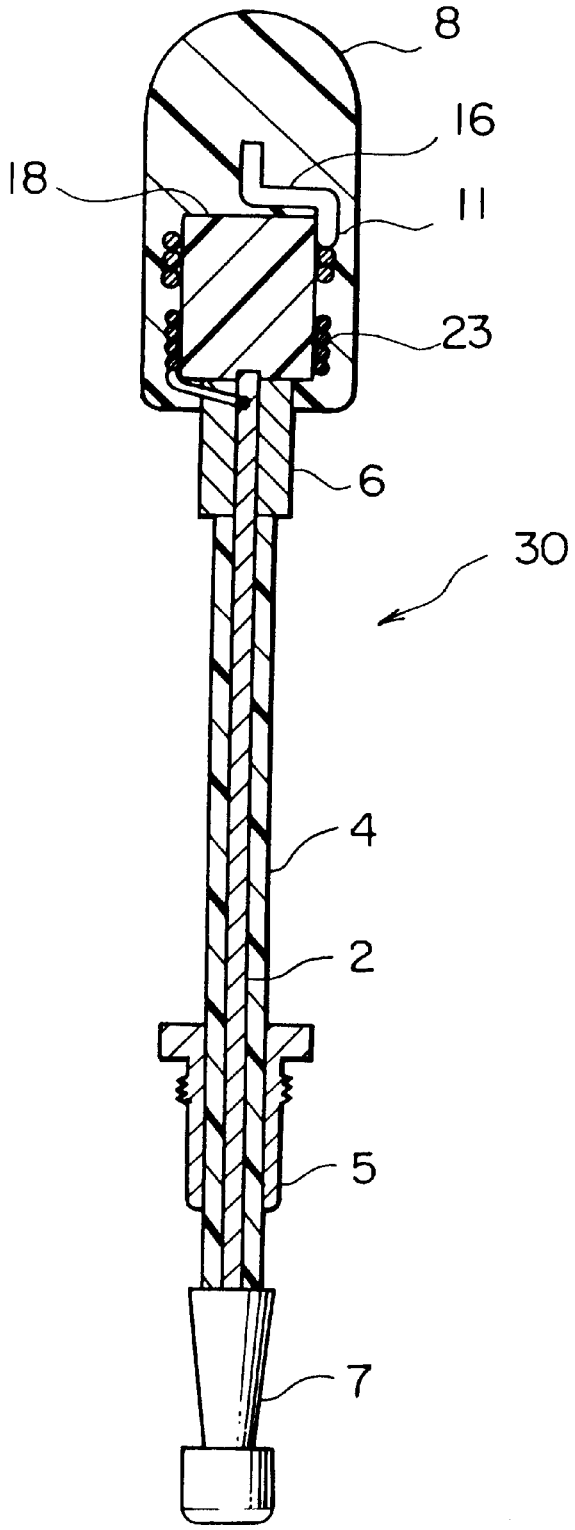
FIG. 5 is a sectional view showing a multi-band antenna according to a third preferred embodiment of the present invention.

Referring now to FIG. 5, a multi-band antenna 30 according to the third preferred embodiment of the present invention will be described. In FIG. 5, the multi-band antenna 30 has, at a portion of a helical element 11 being a first radiation element, an inductor portion 23 in the form of an air-core coil having self-resonance, so as to form an LC parallel trap circuit by the self-resonance. The other structures are the same as those of the multi-band antenna 20 shown in FIG. 4, except that helical guide 17 shown in FIG. 4 is replaced by the corresponding helical guide 18.

Figure 6:
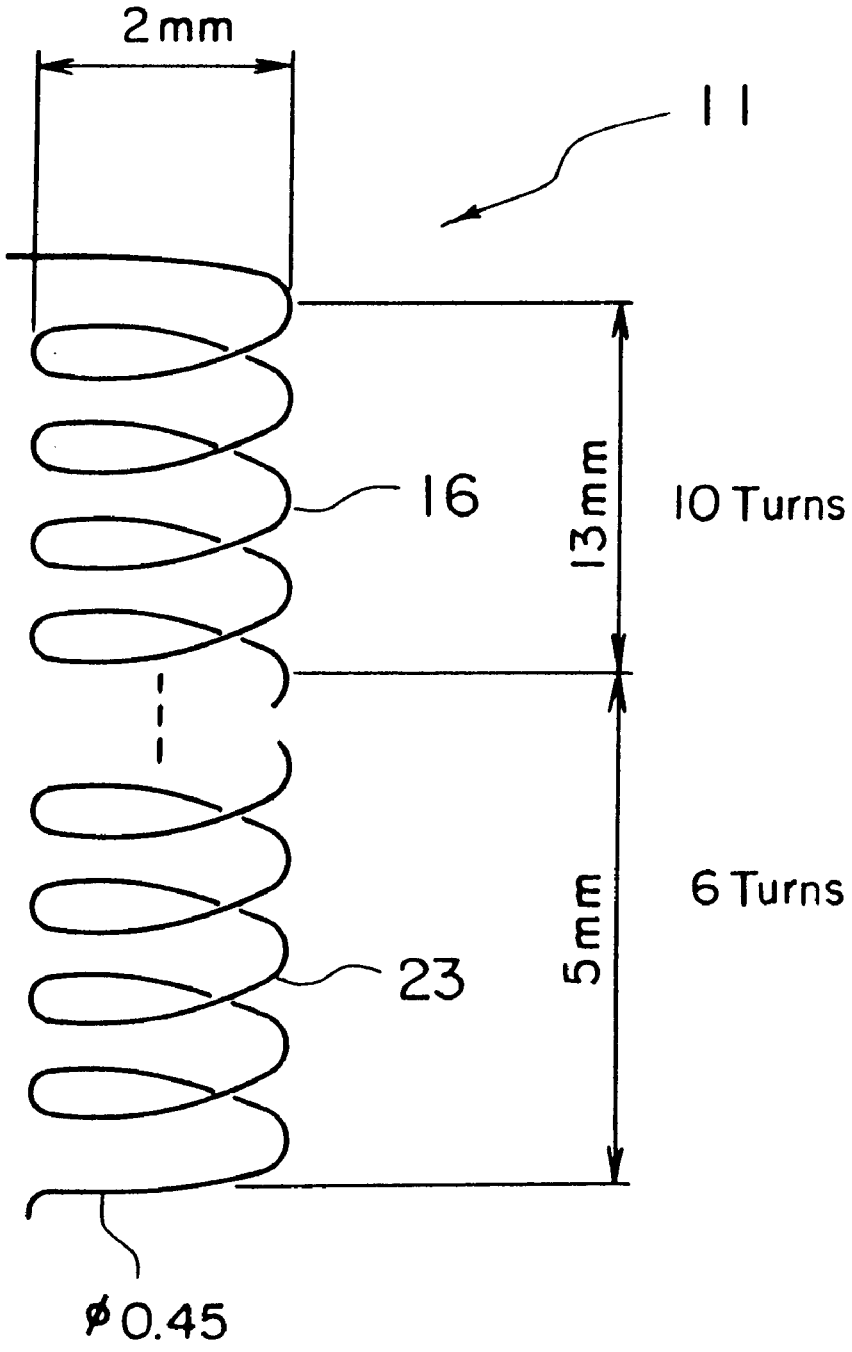
FIG. 6 is a diagram showing a helical element of the multi-band antenna shown in FIG. 5.

A linear element 2 on the telephone side has the same shape as that of the linear element 2 shown in FIG. 1. Further, as shown in FIG. 6, the helical element 11 comprises an integral coil having the inductor portion 23 of the trap circuit and a helical coil 16. With this arrangement, a multi-band characteristic similar to that of the multi-band antenna 10 shown in FIG. 1 was obtained.

Referring further to FIG. 6, the composite coil having the inductor portion 23 and the helical coil 16 will be explained. The inductor portion 23 is in the form of a coil having a length of 5 mm, which is obtained by winding a wire having a diameter of 0.45 mm so as to have an inner diameter of 2 mm and six turns. On the other hand, the helical coil 16 is in the form of a coil having a length of 13 mm, which is obtained by winding a wire having a diameter of 0.45 mm so as to have an inner diameter of 2 mm and ten turns. With this arrangement, the multi-band characteristic similar to that of the multi-band antenna 10 shown in FIG. 1 was obtained.

Figure 7:
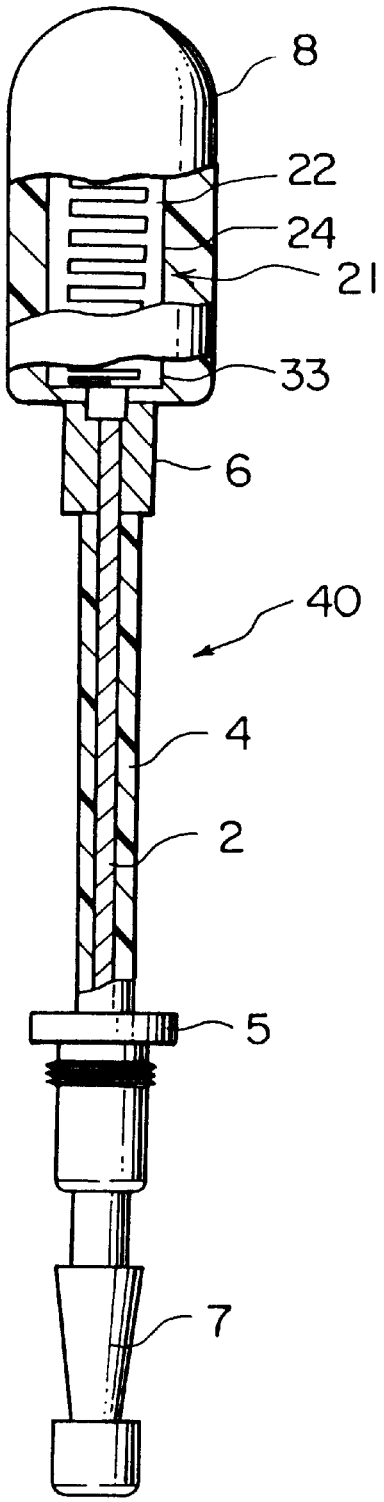
FIG. 7 is a sectional view showing a multi-band antenna according to a fourth preferred embodiment of the present invention.

Referring now to FIG. 7, a multi-band antenna 40 according to the fourth preferred embodiment of the present invention will be described. In FIG. 7, the multi-band antenna 40 is provided with a meander pattern element 21 having, at a portion of a printed board 24 formed with a meander pattern 22, an inductor portion 33 having self-resonance, so as to form an LC parallel trap circuit by the self-resonance. A linear element 2 on the telephone side is in the form of a Ti—Ni superelastic wire having a diameter of 0.8 mm and a length of 31 mm. By using the meander pattern element 21 including the trap circuit, a multi-band characteristic similar to that of the multi-band antenna 10 shown in FIG. 1 can be obtained.

Figure 8:
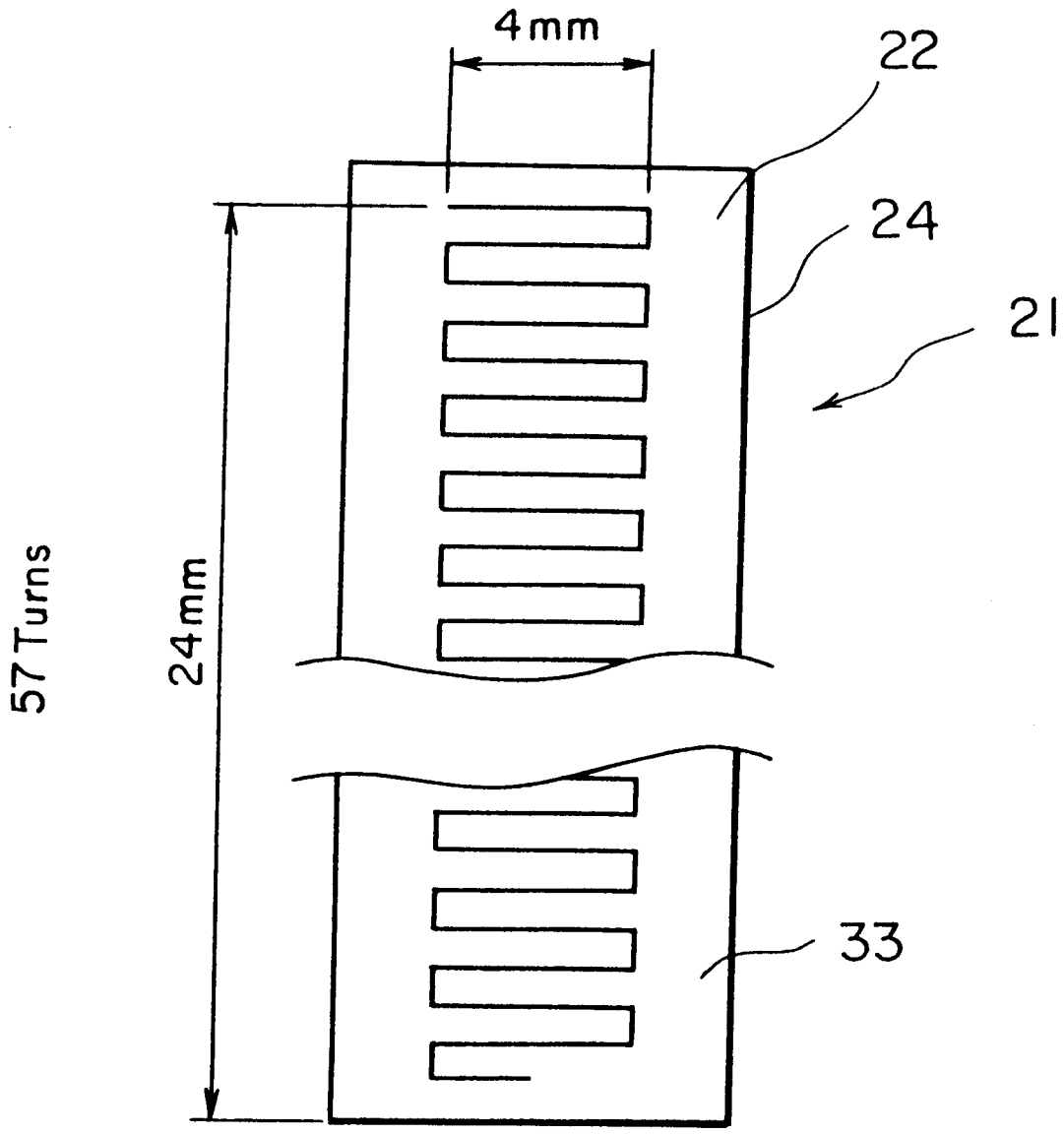
FIG. 8 is a partly cutout diagram showing a meander pattern element of the multi-band antenna shown in FIG. 7.

Referring to FIG. 8, the meander pattern element 21 will be explained in further detail. The meander pattern element 21 is formed by using a helical element having a pattern width of 0.5 mm, 24 turns, a coil width of 4 mm and a whole coil length of 24 mm. With this arrangement, the multi-band antenna 40 shown in FIG. 7 achieved a multi-band characteristic similar to that of the multi-band antenna 10 shown in FIG. 1.

In each of the multi-band antennas according to the first to fourth preferred embodiments, the LC parallel resonance circuit is formed by the self-resonance of the inductor itself.

In general, when using an LC parallel resonance circuit in the form of a combination of an inductance element and a capacitance element, not less than two components such as a capacitor and a coil are necessary. On the other hand, a resonance circuit using self-resonance of an inductor has basically one inductance element, and a capacitance is formed by a distributed capacitance of a coil. Thus, the number of components can be made small. Further, since the capacitance formed by the distributed capacitance is small as a constant so that the resonance circuit is constituted by inductance-leading LC resonance (for example, not less than 7 nH and not greater than 1 pF at 1.9 GHz, not less than 8 nH and not greater than 1 pF at 1.8 GHz), a band width at each frequency can be set large (for example, not greater than VSWR2.2). Therefore, the multi-band antenna with less number of components, with less number of manufacturing processes/steps and with excellent productivity can be provided at a low price.

Further, when the foregoing multi-band antenna is used as an antenna for carrying out transmission and reception at a plurality of mutually different frequency bands, such as 800 MHz and 1.9 GHz, it can largely contribute to reduction in size of a multi-band portable radio device etc.

Figure 9A:
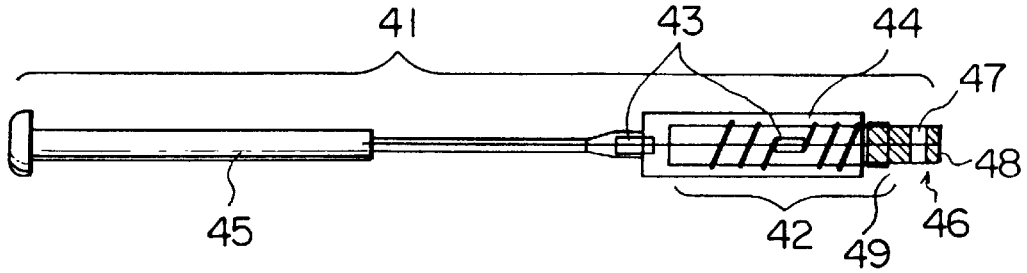
FIG. 9A is a diagram showing a multi-band antenna upon expansion according to a fifth preferred embodiment of the present invention.
Figure 9B:
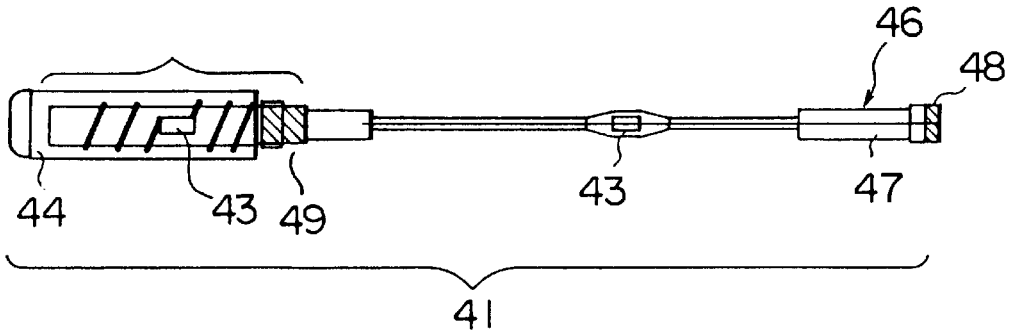
FIG. 9B is a diagram showing the multi-band antenna upon putting back according to the fifth preferred embodiment of the present invention.

Referring now to FIGS. 9A and 9B, a telescopic multi-band whip antenna as a multi-band antenna according to the fifth preferred embodiment of the present invention will be described. The telescopic multi-band whip antenna comprises a whip antenna 41 and a small-size antenna 42. The whip antenna 41 is in the form of a combination of an insulating portion 45 and an LC parallel resonance circuit 43 including a chip inductor and a chip capacitor. The small-size antenna 42 is a small-size multi-band antenna which is formed by combining a helical coil antenna provided on a casing of the radio device and the LC parallel resonance circuit 43 and further by putting a cap 44 thereon. The whip antenna 41 is slidable in the small-size antenna 42.

FIG. 9A is a diagram showing the multi-band antenna upon expansion thereof, wherein a stopper 46 is coupled to a holder 49 for retaining it. The holder 49 is used for fixing the small-size antenna 42 to the casing of the radio device. The stopper 46 is formed at its tip portion with a conductive portion 48 and an insulating portion 47. The insulating portion 47 is mechanically retained by the holder 49 upon expansion of the multi-band antenna so that the whip antenna 41 and the small-size antenna 42 are electrically separated. In this event, the conductive portion 48 is connected to a circuit within the casing of the radio device via a matching circuit.

FIG. 9B is a diagram showing the multi-band antenna upon putting back the multi-band antenna, wherein the holder 49 for fixing the small-size antenna 42 to the casing of the radio device is coupled to the insulating portion 45 of the whip antenna 41. In this event, the holder 49 is connected to the circuit within the casing of the radio device via the matching circuit.

In FIGS. 9A and 9B, the LC parallel resonance circuit 43 composed of the chip inductor and the chip capacitor is used. On the other hand, a similar telescopic multi-band whip antenna can also be realized by using self-resonance of a chip inductor or an air-core coil, or a dielectric resonator having a size of 2 mm×2 mm to 3 mm×3 mm and made of a barium titanate material having a dielectric constant not less than 20. Further, a similar multi-band whip antenna can also be realized by using a circuit connected by using self-resonance of a chip inductor or an air-core coil.

Figure 10A:
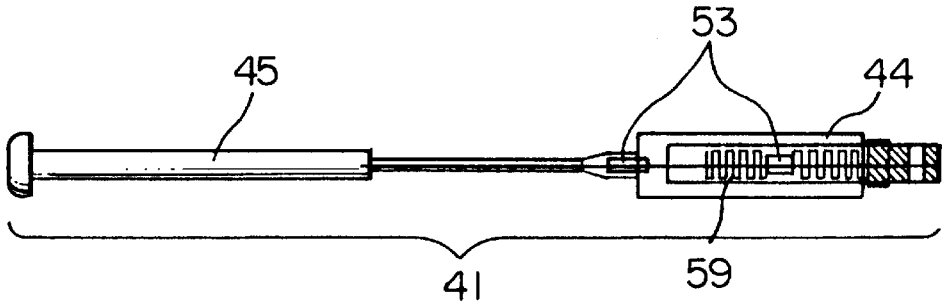
FIG. 10A is a diagram showing a multi-band antenna upon expansion according to a sixth preferred embodiment of the present invention.
Figure 10B:
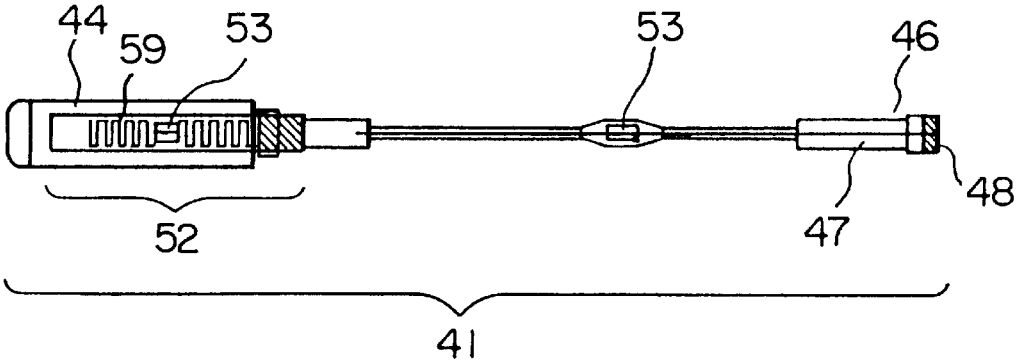
FIG. 10B is a diagram showing the multi-band antenna upon putting back according to the sixth preferred embodiment of the present invention.

Referring now to FIGS. 10A and 10B, a telescopic multi-band whip antenna as a multi-band antenna according to the sixth preferred embodiment of the present invention will be described. FIGS. 10A and 10B are diagrams showing the telescopic multi-band whip antenna upon expansion and upon putting back, respectively. The same or like elements are represented by the same reference signs so as to omit explanation thereof.

In the telescopic multi-band whip antenna in this embodiment, a small-size antenna 52 has a flexible board formed thereon with a meander line pattern 59, and further provided thereon with an LC parallel resonance circuit 53 comprising a chip inductor and a chip capacitor, so as to accomplish a multi-band characteristic. A similar telescopic multi-band whip antenna can also be realized using self-resonance of a chip inductor or an air-core coil.

Figure 11A:
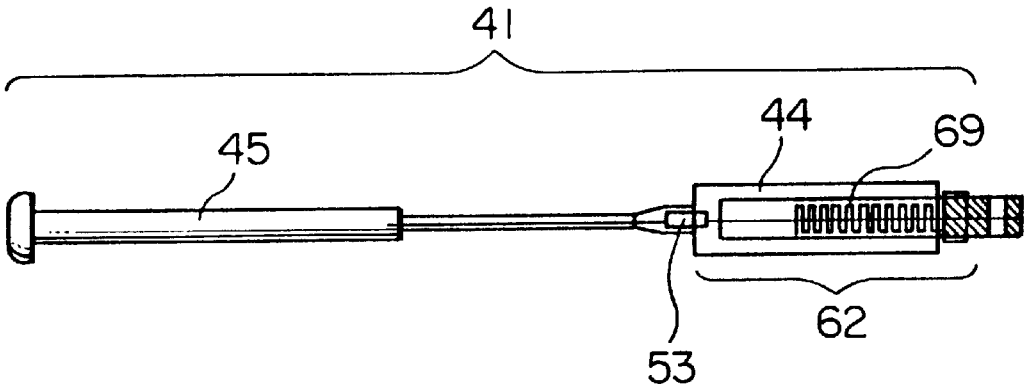
FIG. 11A is a diagram showing a multi-band antenna upon expansion according to a seventh preferred embodiment of the present invention.
Figure 11B:
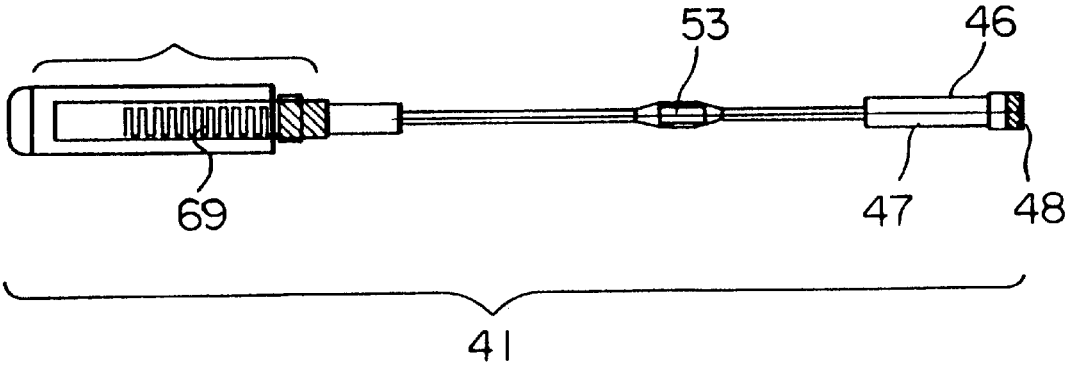
FIG. 11B is a diagram showing the multi-band antenna upon putting back according to the seventh preferred embodiment of the present invention.

Referring now to FIGS. 11A and 11B, a telescopic multi-band whip antenna as a multi-band antenna according to the seventh preferred embodiment of the present invention will be described. FIGS. 11A and 11B are diagrams showing the telescopic multi-band whip antenna upon expansion and upon putting back, respectively. The same or like elements are represented by the same reference signs so as to omit explanation thereof.

In the telescopic multi-band whip antenna in this embodiment, a small-size antenna 62 is not provided with the LC parallel resonance circuit, and thus realizes a multi-band characteristic only by a meander pattern 69 formed on a flexible board.

In each of the multi-band antennas according to the fifth to seventh preferred embodiments, the electric characteristics of the small-size antenna and the whip antenna are both set to be the multi-band characteristics so that the multi-band characteristics can be obtained both upon expansion and putting back. Specifically, when the foregoing multi-band antenna is used as an antenna for carrying out transmission and reception at a plurality of mutually different frequency bands, such as 800 MHz and 1.9 GHz, it can largely contribute to reduction in size of a multi-band portable radio device etc.

Figure 12:
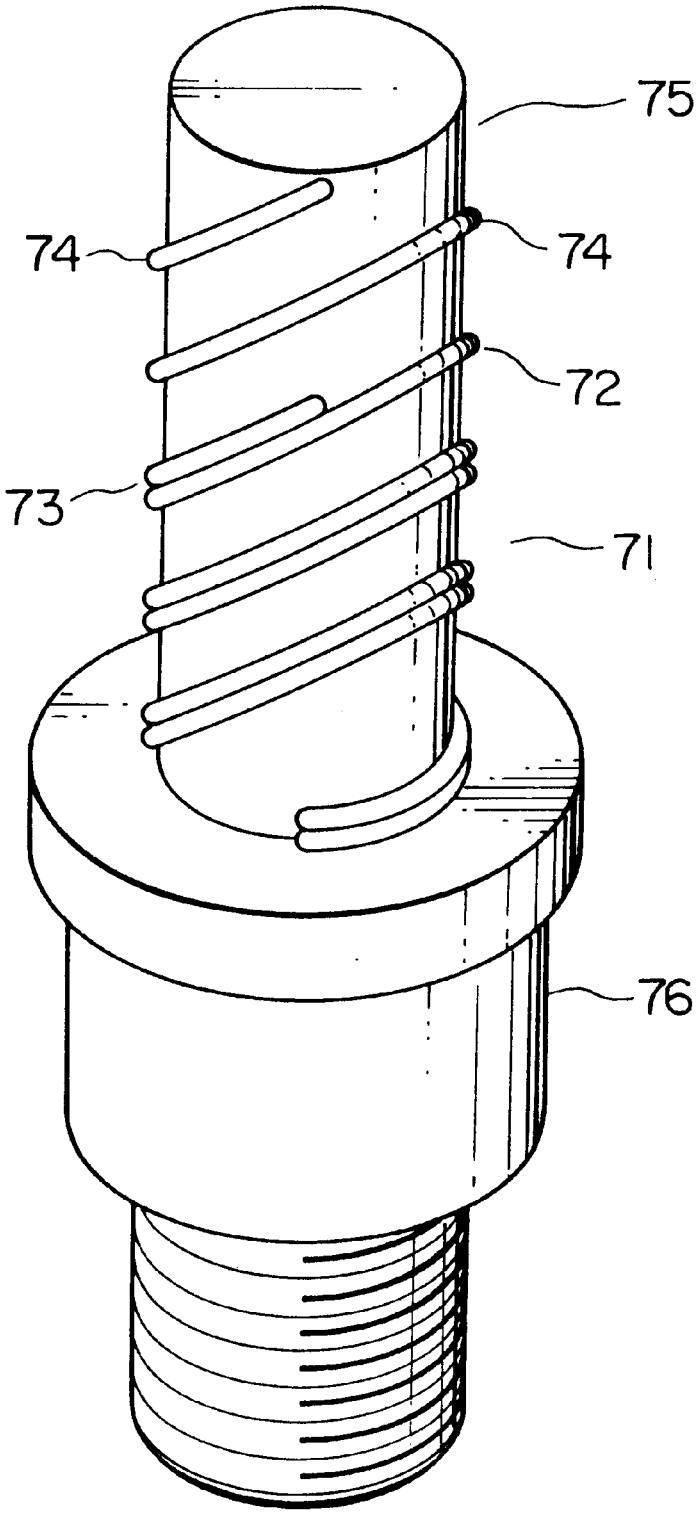
FIG. 12 is a perspective view showing a multi-band antenna according to an eighth preferred embodiment of the present invention.

Referring now to FIG. 12, a multi-band helical antenna as a multi-band antenna according to the eighth preferred embodiment of the present invention will be described.

A helical antenna 72 is formed by winding a helical coil 74 around a helical guide with five turns, while a helical antenna 73 is formed by winding a helical coil 74 around the helical guide 75 with three turns. The respective helical coils 74, 74 are in close contact with or soldered to a conductive holder 76 at their first turns so as to be fed with power parallelly. The holder 76 holds the helical guide 75. By putting a cap (not shown) on the helical guide 75 and the helical antennas 72 and 73 and bonding it thereto, a multi-band helical antenna 71 is constituted.

Since lengths of the helical antennas 72 and 73 differ from each other, resonance frequencies thereof also differ from each other. Thus, the multi-band helical antenna 71 having two resonance frequencies can be realized.

Figure 13:
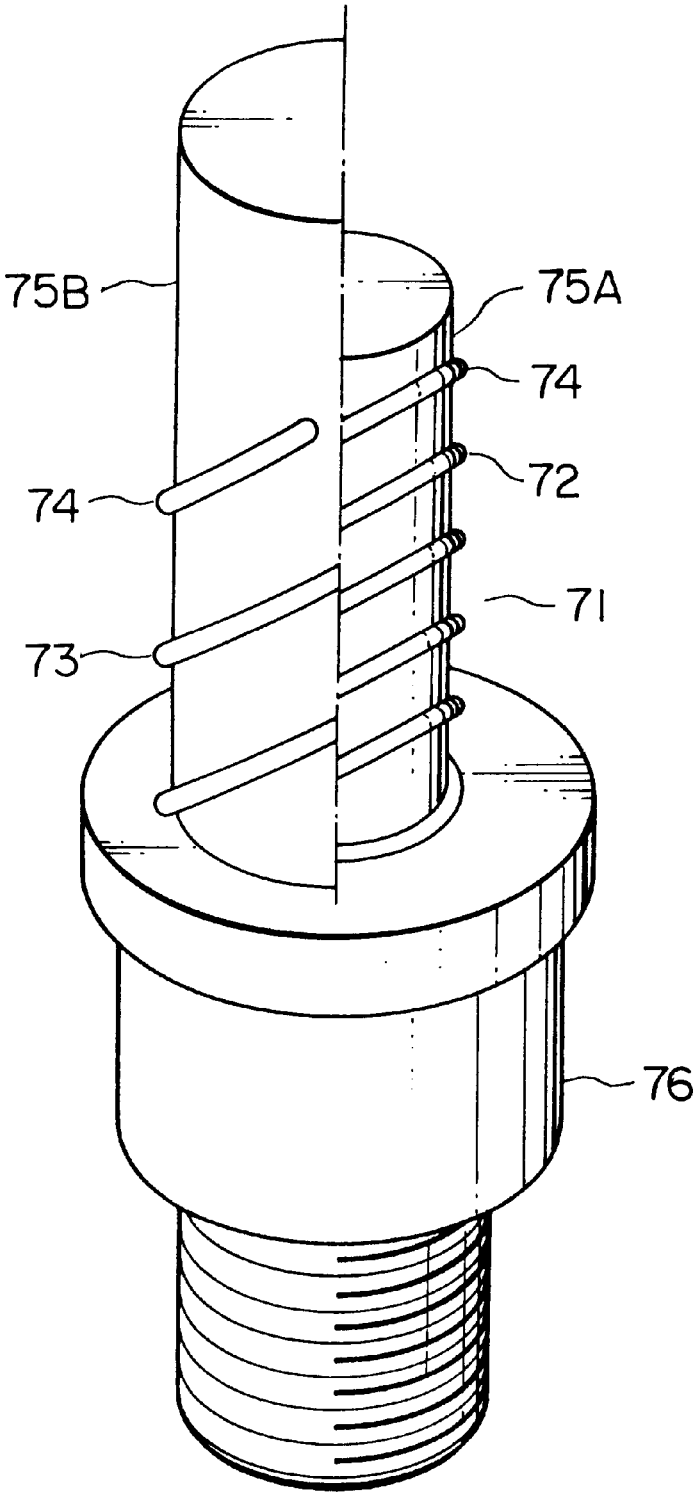
FIG. 13 is a perspective view showing a multi-band antenna according to a ninth preferred embodiment of the present invention.

Referring now to FIG. 13, a multi-band helical antenna as a multi-band antenna according to the ninth preferred embodiment of the present invention will be described. FIG. 13 shows the state wherein a right-side half of a helical antenna 73 is removed.

A helical antenna 72 is formed by winding a helical coil 74 around a small-diameter helical guide 75A with five turns. The helical antenna 73 is formed by winding a helical coil 74 around a large-diameter hollow helical guide 75B with three turns. The helical guides 75A and 75B are arranged concentrically and overlapped with each other. The respective helical coils 74, 74 are in close contact with or soldered to a conductive holder 76 at their first turns so as to be fed with power parallelly. The holder 76 holds the helical guides 75A and 75B. By putting a cap (not shown) on the helical guide 75B and the helical antenna 73 and bonding it thereto, a multi-band helical antenna 71 is constituted.

Since lengths of the helical antennas 72 and 73 differ from each other, resonance frequencies thereof also differ from each other. Thus, the multi-band helical antenna 71 having two resonance frequencies can be realized.

Further, since diameters of the helical antennas 72 and 73 differ from each other, band widths of the two resonance frequencies can be adjusted so that desired band widths can be achieved.

It may be arranged that the helical coils 74, 74 are connected in series, and only one of the helical coils is fed with power.

Figure 14:
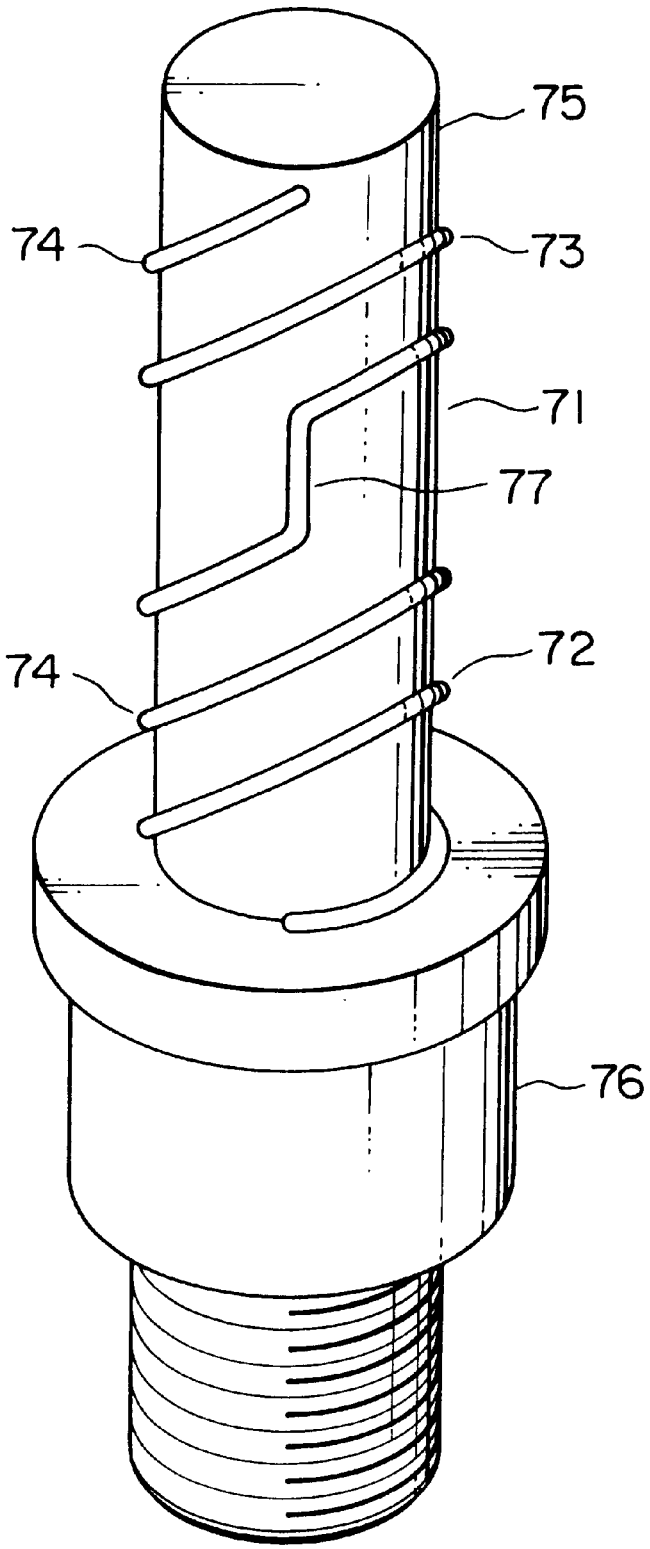
FIG. 14 is a perspective view showing a multi-band antenna according to a tenth preferred embodiment of the present invention.

Referring now to FIG. 14, a multi-band helical antenna as a multi-band antenna according to the tenth preferred embodiment of the present invention will be described.

A helical antenna 72 is formed by winding a helical coil 74 around a helical guide 75 with three turns. A helical antenna 73 is formed by winding a helical coil 74 around the helical guide 75 with two turns. The helical antennas 72 and 73 are connected in series by a serially connecting portion 77. The helical coil 74 of the helical antenna 72 is in close contact with or soldered to a conductive holder 76 at its first turn so as to be fed with power. The holder 76 holds the helical guide 75. By putting a cap (not shown) on the helical guide 75 and the helical antennas 72 and 73 and bonding it thereto, a multi-band helical antenna 71 is constituted.

Since lengths of the helical antennas 72 and 73 differ from each other, resonance frequencies thereof also differ from each other. Thus, the multi-band helical antenna 71 having two resonance frequencies can be realized.

Figure 15:
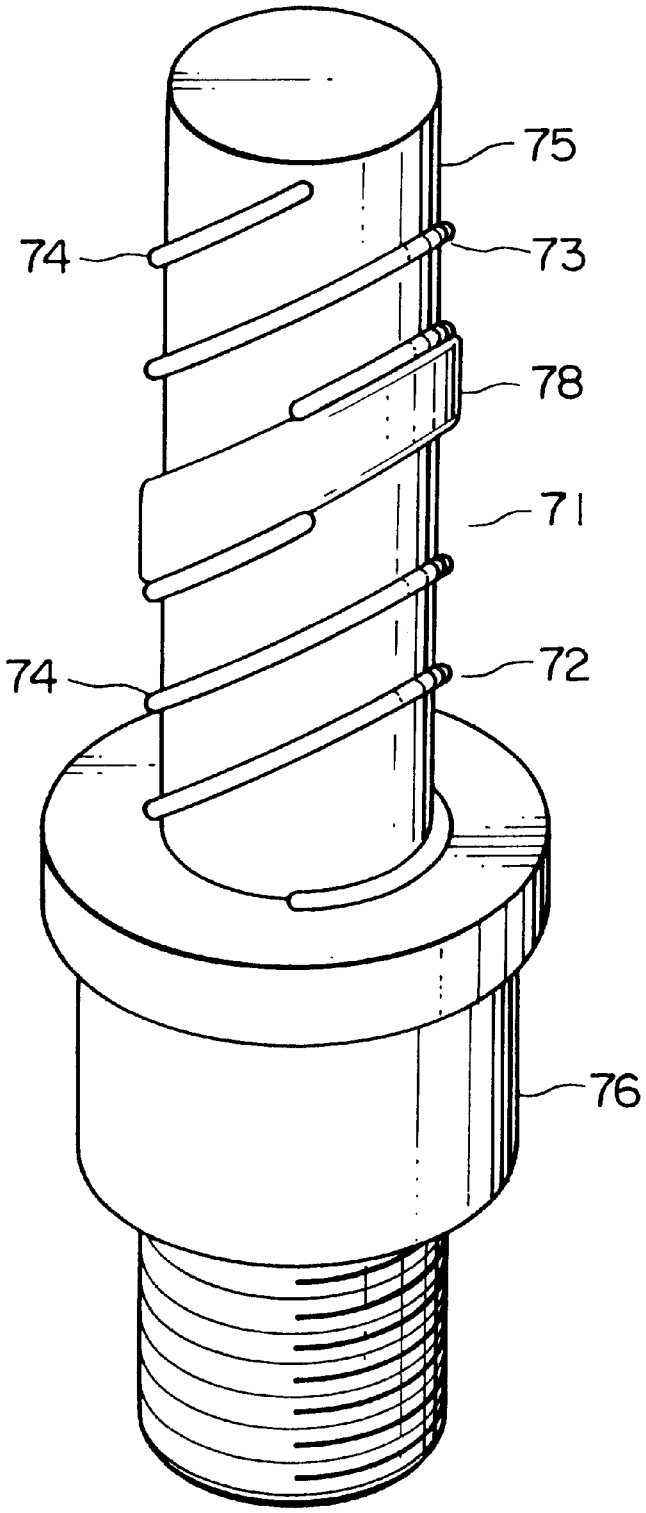
FIG. 15 is a perspective view showing a multi-band antenna according to an eleventh preferred embodiment of the present invention.

Referring now to FIG. 15, a multi-band helical antenna as a multi-band antenna according to the eleventh preferred embodiment of the present invention will be described.

A helical antenna 72 is formed by winding a helical coil 74 around a helical guide 75 with three turns. A helical antenna 73 is formed by winding a helical coil 74 around the helical guide 75 with two turns. The helical antennas 72 and 73 are separated from each other by a helical insulating portion 78, being a dielectric, provided on the surface or circumference of the helical guide 75. The helical coil 74 of the helical antenna 72 is in close contact with or soldered to a conductive holder 76 at its first turn so as to be fed with power. The holder 76 holds the helical guide 75. The helical antenna 73 is fed with power through capacitive coupling to the helical antenna 72. By putting a cap (not shown) on the helical guide 75 and the helical antennas 72 and 73 and bonding it thereto, a multi-band helical antenna 71 is constituted.

Since lengths of the helical antennas 72 and 73 differ from each other, resonance frequencies thereof also differ from each other. Thus, the multi-band helical antenna 71 having two resonance frequencies can be realized.

In each of the multi-band antennas according to the eighth to eleventh preferred embodiments, the multi-band characteristic is obtained by using a plurality of helical coils. Specifically, when the foregoing multi-band antenna is used as an antenna for carrying out transmission and reception at a plurality of mutually different frequency bands, such as 800 MHz and 1.9 GHz, it can largely contribute to reduction in size of a multi-band portable radio device etc.

Figure 16:
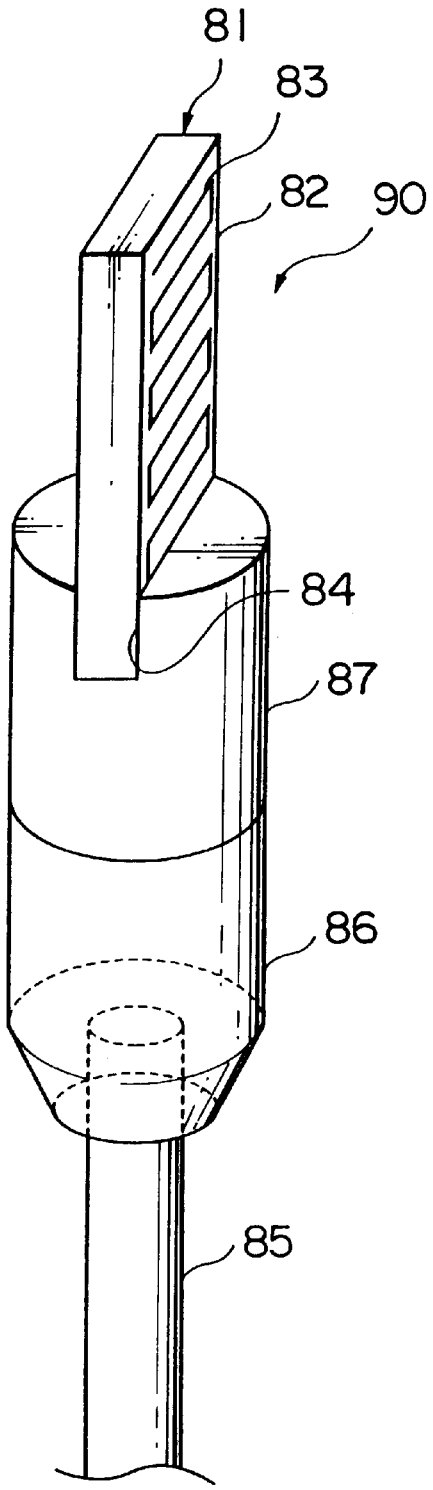
FIG. 16 is a perspective view showing a main part of a multi-band antenna according to a twelfth preferred embodiment of the present invention.
Figure 17:
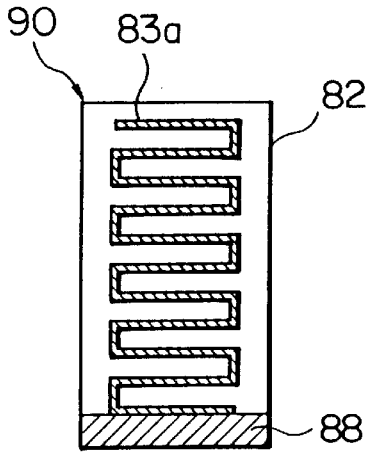
FIG. 17 is a front view showing a small-size antenna incorporated in the multi-band antenna shown in FIG. 16.

Referring now to FIGS. 16 and 17, a telescopic whip antenna as a multi-band antenna according to the twelfth preferred embodiment of the present invention will be described.

In the telescopic whip antenna in this embodiment, a sleeve 87 working as a feed point is formed with a groove 84 into which an antenna member 81 in the form of a printed board 82 formed thereon with an electrode pattern 83 is fitted, and a connecting portion 88 connected to one end of a meander line pattern electrode (hereinafter referred to as "meander pattern") 83*a* is electrically and fixedly connected, by soldering or under pressure, to the conductive sleeve 87 coupled to a coupling portion 86, made of insulating resin, provided at one end of a rod antenna 85, so as to constitute a small-size antenna 90.

An actual product has a cap (not shown) for antenna protection. For comparison, an equation (1) for calculating an inductance of the conventional helical coil and equations (2) to (4) for calculating an inductance of the small-size coil according to this embodiment will be shown hereinbelow.

Coil:

$$L\ \text{coil} = K\frac{4\pi SN^2}{1}\times 10^{-9}\ \ [\text{H}] \tag{1}$$

wherein S represents a sectional area ($cm^2$), N the number of turns, l a mean magnetic circuit length (cm) and k a Nagaoke coefficient.

Given that a self-inductance of the meander line is Ls, the following equation (2) is established based on the F. E. Terman equation:

Meander:

$$Ls = 200\,lm\left(\ln\left(\frac{lm}{W+t}\right) + 1.19 + 0.22\frac{W+t}{lm}\right)\ \ [\text{nH}] \tag{2}$$

wherein a mutual inductance Lij (a mutual inductance between i-th and j-th) is given by the following equation (3) based on the Greenhouse equation:

$$Lij = 200\,lmKN\ \ [\text{nH}] \tag{3}$$

$$KN = \ln\left(\left(\frac{lm}{DN}\right) + \sqrt{1+\left(\frac{lm}{DN}\right)^2}\right) - \sqrt{1+\left(\frac{DN}{lm}\right)^2} + \frac{DN}{lm}$$

wherein DN=N(dc+W) represents a distance between conductors depending on the number of meanders, dc a distance (m) between conductors, N the number of meanders, and 2N the number of conductors.

An inductance La of the meander pattern is given by the following equation (4):

$$La = \left(2NLs + 2\sum_i\sum_j Lij(-1)^{ij}\right)\cdot(i+1=j)\ \ [\text{nH}] \tag{4}$$

In case of a helical coil, an inductance is proportional to the square of the number of turns and thus an equation for calculating it largely differs from the equation for the meander line.

Resonance frequencies are each derived by the following equation (5) using a line capacitance C and the inductance L derived above:

$$f = 1/2\pi\sqrt{LC} \tag{5}$$

In case of a helical coil, it is fixed to a helical guide provided with grooves at constant pitches so as to avoid dispersion in line capacitance C.

The meander pattern 83*a* is formed by etching the printed board 82. In general, a pattern width can be achieved with an accuracy of ±20 μm error. Therefore, the line capacitance can be constant without using the member for uniforming the pitches as required in the helical coil so that the dispersion in resonance frequency can be suppressed. Reduction in weight of the small-size antenna can also be achieved. Further, since the antenna member 81 is only fitted into the groove 84 of the sleeve 87 upon assembling, the productivity is high. Moreover, since the feed point is determined by fixing the printed board 82, the dispersion in resonance frequency due to dispersion in feed point can also be suppressed.

Figure 18:
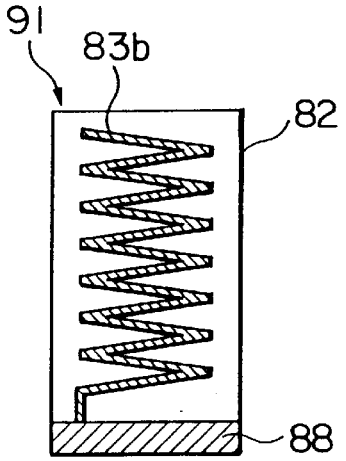
FIG. 18 is a front view showing a small-size antenna incorporated in a multi-band antenna according to a thirteenth preferred embodiment of the present invention.

Referring now to FIGS. 16 and 18, a telescopic whip antenna as a multi-band antenna according to the thirteenth preferred embodiment of the present invention will be described.

In the telescopic whip antenna in this embodiment, like the one shown in FIG. 16, a sleeve 87 working as a feed point is formed with a groove 84, and an antenna member 91 in the form of a printed board 82 formed thereon with a sawtooth line pattern or a jagged line pattern (hereinafter collectively referred to as "sawtooth pattern") 83*b* as an electrode pattern 83 is fitted into the groove 84 and fixed thereto by soldering or under pressure so as to constitute a small-size antenna.

An actual product has a cap (not shown) for antenna protection.

As shown in FIG. 18, like the meander line pattern 83*a* shown in FIG. 17, the sawtooth pattern 83*b* is formed by etching the printed board. In general, a pattern width can be achieved with an accuracy of ±20 μm error. Therefore, the line capacitance can be constant without using the member for uniforming the pitches as required in the helical coil so that the dispersion in resonance frequency can be suppressed. Reduction in weight of the small-size antenna can also be achieved.

Further, as shown in FIG. 16, since the antenna member is only fitted into the groove 84 of the sleeve 87 upon assembling, the productivity is high. Moreover, since the feed point is determined by fixing the printed board 82, the dispersion in resonance frequency due to dispersion in feed point can also be suppressed.

Figure 19:
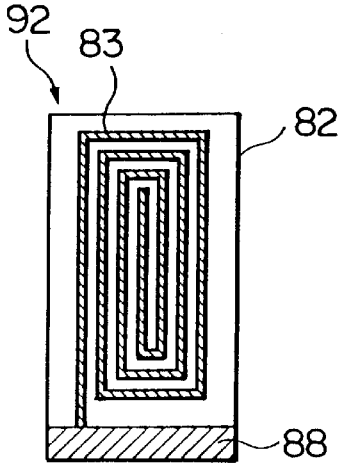
FIG. 19 is a front view showing a small-size antenna incorporated in a multi-band antenna according to a fourteenth preferred embodiment of the present invention.

Referring now to FIGS. 16 and 19, a telescopic whip antenna as a multi-band antenna according to the fourteenth preferred embodiment of the present invention will be described.

In the telescopic whip antenna in this embodiment, like the one shown in FIG. 16, a sleeve 87 working as a feed point is formed with a groove 84, and an antenna member 92 in the form of a printed board 82 formed thereon with a spiral pattern 83*c* as an electrode pattern 83 is fitted into the groove 84 and fixed thereto by soldering or under pressure so as to constitute a small-size antenna. An actual product has a cap (not shown) for antenna protection.

Hereinbelow, an equation (6) for calculating an inductance of the conventional helical coil and an equation (7) for calculating an inductance of the spiral pattern according to this embodiment will be shown hereinbelow.

Coil:

$$L\ \text{coil} = K\frac{4\pi SN^2}{1}\times 10^{-9}\ \ [\text{H}] \tag{6}$$

wherein S represents a sectional area ($cm^2$), N the number of turns, l a mean magnetic circuit length (cm) and k a Nagaoke coefficient.

Spiral:

$$L\ \text{spiral} = 0.141\ an^{5/3}\log 8a/c\quad [\mu\text{H}] \tag{7}$$

$$a = \frac{D_i + D_o}{4},\qquad c = \frac{D_o - D_i}{2}$$

wherein l represents a conductor radius (cm), n the number of turns, Di a spiral inner diameter (inch), and Do a spiral outer diameter (inch).

Resonance frequencies are each derived by the following equation (8) using a line capacitance C and the inductance L derived above:

$$f = 1/2\pi\sqrt{LC} \tag{8}$$

Like the meander pattern 83*a* and the sawtooth pattern 83*b*, the spiral pattern 83*c* is formed by etching the printed board 82. In general, a pattern width can be achieved with an accuracy of ±20 $\mu$m error. Therefore, the line capacitance C can be constant without using the member for uniforming the pitches as required in the helical coil so that the dispersion in resonance frequency can be suppressed. Reduction in weight of the small-size antenna can also be achieved. Further, since the antenna member 92 is only fitted into the groove 84 of the sleeve 87 upon assembling, the productivity is high. Moreover, since the feed point is determined by fixing the printed board 82, the dispersion in resonance frequency due to dispersion in feed point can also be suppressed.

In each of the multi-band antennas according to the twelfth to sixteenth preferred embodiments, the inductance has been explained. On the other hand, by forming a board of, for example, dielectric ceramic such as barium titanate having $\epsilon$ of 20 to 110 so as to constitute a microstrip antenna between the meander electrode (meander pattern 83*a*), the sawtooth electrode (sawtooth pattern 83*b*) or the spiral electrode (spiral pattern 83*c*) and the ground, it is further effective in size reduction of the antenna.

Figure 20:
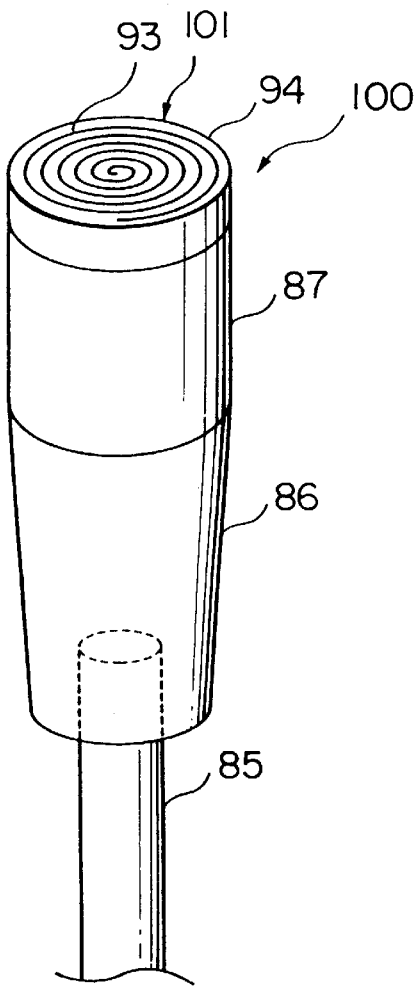
FIG. 20 is a perspective view showing a main part of a multi-band antenna according to a fifteenth preferred embodiment of the present invention.
Figure 21:
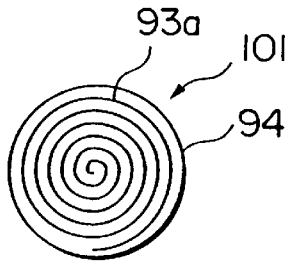
FIG. 21 is a plan view showing a small-size antenna incorporated in the multi-band antenna shown in FIG. 20.

Referring now to FIGS. 20 and 21, a telescopic whip antenna as a multi-band antenna according to the fifteenth preferred embodiment of the present invention will be described.

In the telescopic whip antenna in this embodiment, as an electrode pattern 93 having the same outside dimension as that of a sleeve 87 working as a feed point, a round and flat spiral pattern 93*a* is used. The spiral pattern 93*a* is formed on the surface of a circular printed board 94 and has an initial wind part connected to the underside of the printed board 94 via a through hole (not shown), so as to form an antenna member 101. The antenna member 101 is fixed to the sleeve 87 by soldering or under pressure so as to be fed with power.

An actual product has a cap (not shown) for antenna protection.

Like the meander pattern 83*a* and the sawtooth pattern 83*b* described above, the spiral pattern 93*a* is formed by etching the printed board 94. In general, a pattern width can be achieved with an accuracy of ±20 $\mu$m error. Therefore, the line capacitance can be constant without using the member for uniforming the pitches as required in the conventional helical coil so that the dispersion in resonance frequency can be suppressed.

Reduction in weight of a small-size antenna 100 can also be achieved. Further, since the printed board 94 is only connected onto the sleeve 87 upon assembling, the productivity is high. Moreover, since the feed point is determined by fixing the printed board 94, the dispersion in resonance frequency due to dispersion in feed point can also be suppressed.

Figure 22:
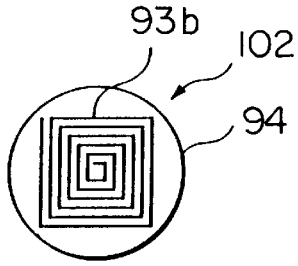
FIG. 22 is a plan view showing a small-size antenna incorporated in a multi-band antenna according to a sixteenth preferred embodiment of the present invention.

Referring now to FIGS. 20 and 22, a telescopic whip antenna as a multi-band antenna according to the sixteenth preferred embodiment of the present invention will be described.

The telescopic whip antenna in this embodiment is the same in structure as the telescopic whip antenna shown in FIG. 20 except that, instead of the round spiral pattern 93*a* shown in FIG. 21, an angular spiral pattern 93*b* having the same outside dimension as that of a sleeve 87 working as a feed point is used. The angular spiral pattern 93*b* is formed on the surface of a circular printed board 94 and has an initial wind part connected to the underside of the printed board 94 via a through hole (not shown), so as to form an antenna member 102. The antenna member 102 is fixed to the sleeve 87 by soldering or under pressure so as to be fed with power.

An actual product has a cap (not shown) for antenna protection.

Like the meander pattern 83*a* and the sawtooth pattern 83*b* described above, the spiral pattern 93*b* is formed by etching the printed board 94. In general, a pattern width can be achieved with an accuracy of ±20 $\mu$m error. Therefore, the line capacitance can be constant without using the member for uniforming the pitches as required in the conventional helical coil so that the dispersion in resonance frequency can be suppressed. Reduction in weight of a small-size antenna 100 can also be achieved. Further, since the printed board 94 is only connected onto the sleeve 87 upon assembling, the productivity is high. Moreover, since the feed point is determined by fixing the printed board 94, the dispersion in resonance frequency due to dispersion in feed point can also be suppressed.

Figure 23:
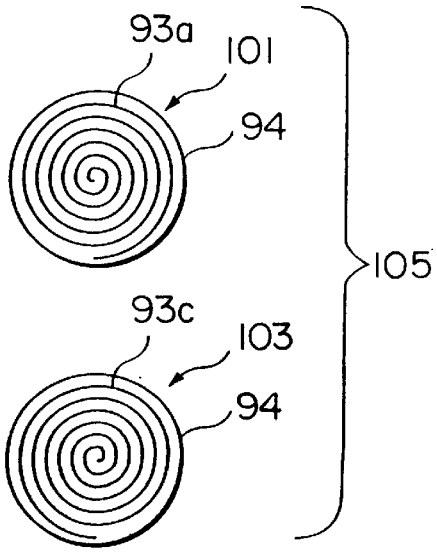
FIG. 23 is a plan view showing a small-size antenna incorporated in a multi-band antenna according to a seventeenth preferred embodiment of the present invention.

Referring now to FIGS. 20 and 23, a telescopic whip antenna as a multi-band antenna according to the seventeenth preferred embodiment of the present invention will be described.

In the telescopic whip antenna in this embodiment, a pair of boards 94, 94 respectively formed with round spiral patterns 93*a* and 93*c* each having the same outside dimension as that of a sleeve 87 working as a feed point are stacked with each other so as to ensure a pattern length. The spiral patterns 93*a* and 93*c* formed on the printed boards 94, 94 have winding directions opposite to each other, that is, a clockwise winding direction and a counterclockwise winding direction. The spiral patterns 93*a* and 93*c* have their respective initial wind parts connected to the undersides of the corresponding printed boards 94, 94 via corresponding through holes (not shown), so as to form an antenna member 105. The antenna member 105 is fixed to the sleeve 87 by soldering or under pressure so as to be fed with power.

An actual product has a cap (not shown) for antenna protection.

Like the meander pattern 83*a* and the sawtooth pattern 83*b* described above, each of the spiral patterns 93*a* and 93*c* is formed by etching the corresponding printed board 94. In general, a pattern width can be achieved with an accuracy of ±20 μm error. Therefore, the line capacitance C can be constant so that the dispersion in resonance frequency can be suppressed. Reduction in weight of the small-size antenna can also be achieved. Further, since the antenna member 105 is only connected onto the sleeve 87 upon assembling, the productivity is high. Moreover, since the feed point is determined by fixing the antenna member 105, the dispersion in resonance frequency due to dispersion in feed point can also be suppressed.

Similar effects can be achieved by combining the angular spiral pattern 93*b* shown in FIG. 22 and another angular spiral pattern having an opposite winding direction.

Figure 24:
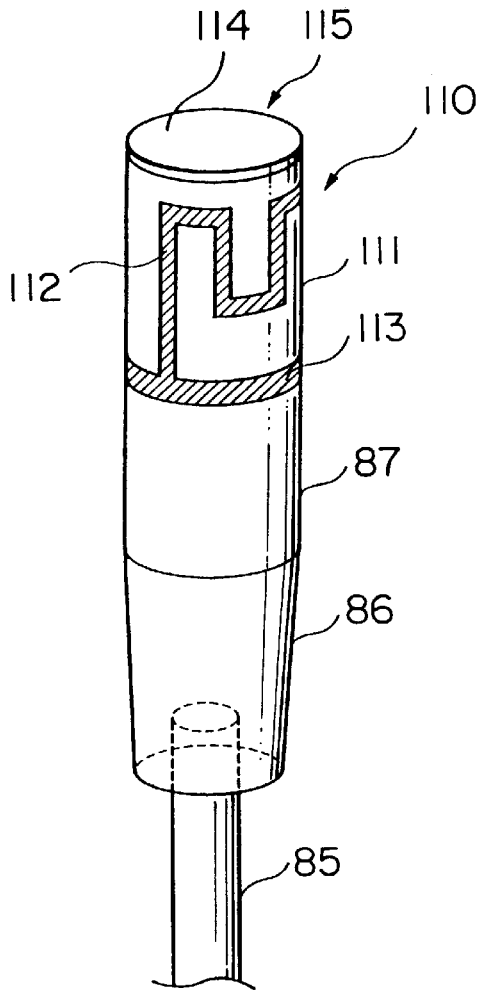
FIG. 24 is a perspective view showing a main part of a multi-band antenna according to an eighteenth preferred embodiment of the present invention.
Figure 25:
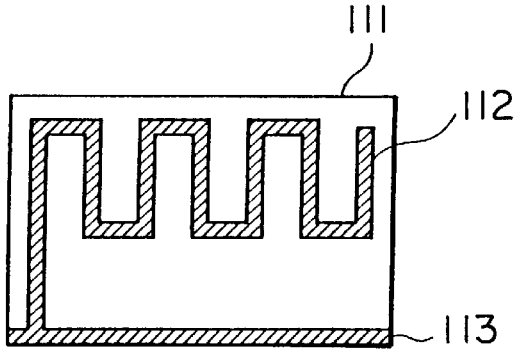
FIG. 25 is a developed view for explaining a main fabricating process of a small-size antenna incorporated in the multi-band antenna shown in FIG. 24.
Figure 26:
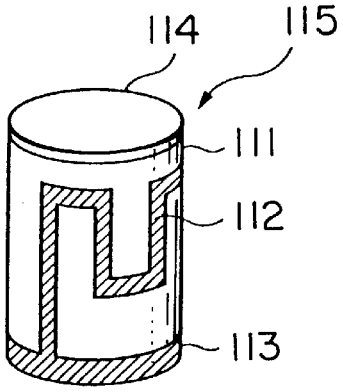
FIG. 26 is a perspective view for explaining a main fabricating process of the small-size antenna incorporated in the multi-band antenna shown in FIG. 24.

Referring now to FIGS. 24 to 26, a telescopic whip antenna as a multi-band antenna according to the eighteenth preferred embodiment of the present invention will be described.

In the telescopic whip antenna in this embodiment, a small-size antenna 110 is provided with an antenna member 115 constituted by forming a meander pattern 112 on a flexible board 111 as best shown in FIG. 25 and then winding it around a cylindrical resin member 114 as best shown in FIG. 26.

For power feeding from one end of the meander pattern 112, a connection electrode 113 provided at one end of the flexible board 111 and the meander pattern 112 are connected to each other. The connection electrode 113 of the antenna member 115 and a sleeve 87 are connected to each other by soldering or under pressure for power feeding.

The meander pattern 112 is formed by etching the flexible board 111 having a conductive metal foil thereover. In general, a pattern width can be achieved with an accuracy of ±20 μm error. Therefore, the line capacitance C can be constant so that the dispersion in resonance frequency can be suppressed.

Further, since the flexible board 111 is only connected onto the sleeve 87 upon assembling, the productivity is high. Moreover, since the feed point is determined by fixing the flexible board 111, the dispersion in resonance frequency due to dispersion in feed point can also be suppressed.

According to the multi-band antennas in each of the twelfth to sixteenth preferred embodiments, the small-size antenna and the rod antenna which is receivable in the casing of the radio device and expandable are combined to provide the telescopic whip antenna. In the telescopic whip antenna, the electrode pattern is formed on the printed board, the flexible board or the dielectric board. By using the resonance frequency based on the dielectric constant of the board and the electrode pattern, there can be provided such a telescopic whip antenna that is excellent in productivity, stable in resonance frequency and reducible in weight, and thus can largely contribute to reduction in size and weight of the portable terminal.

What is claimed is:

1. A multi-band antenna comprising an antenna element having an LC parallel resonance circuit and a first radiation element and a second radiation element connected to respective opposite ends of said LC parallel resonance circuit, wherein said LC parallel resonance circuit comprises a self-resonance inductor, and said inductor is mounted on a printed board.

2. A multi-band antenna as claimed in claim 1, wherein said inductor has an inductance L given by $L \geqq 7$ nH.

3. A multi-band antenna as claimed in claim 1, wherein said first radiation element has a helical shape.

4. A multi-band antenna as claimed in claim 3, wherein said second radiation element is elongate and made of a superelastic alloy.

5. A multi-band antenna as claimed in claim 4, wherein said second radiation element is covered through molding with a flexible insulating material, said flexible insulating material being one of a polymer and an elastomer.

6. A multi-band antenna as claimed in claim 3, wherein said LC parallel resonance circuit and said first radiation element are covered with an insulating material through molding.

7. A multi-band antenna as claimed in claim 6, wherein said insulating material is one of a flexible polymer and a flexible elastomer.

8. A multi-band antenna as claimed in claim 6, wherein said second radiation element is elongate and made of a superelastic alloy.

9. A multi-band antenna comprising an antenna element having an LC parallel resonance circuit and a first radiation element and a second radiation element connected to respective opposite ends of said LC parallel resonance circuit, wherein said first radiation element has a helical shape and a part of said first radiation element comprises a self-resonance inductor which forms said LC parallel resonance circuit.

10. A multi-band antenna as claimed in claim 9, wherein said first radiation element comprises a printed board having a meander pattern.

11. A multi-band antenna as claimed in claim 10, wherein the part of said first radiation element which comprises the self-resonance inductor which forms said LC parallel resonance circuit is a part of said meander pattern.

12. A multi-band antenna as claimed in claim 10, wherein said printed board is covered through molding with a flexible insulating resin, said flexible insulating resin being one of a polymer and an elastomer.

13. A multi-band antenna as claimed in claim 12, wherein said second radiation element is covered through molding with a flexible insulating resin, said flexible insulating resin being one of a polymer and an elastomer.

14. A telescopic multi-band whip antenna comprising a small-size antenna and a whip antenna which is receivable in a radio device casing and expandable therefrom, wherein said small-size antenna is located outside said radio device casing, said whip antenna is slidable relative to said small-size antenna, and each of said small-size antenna and said whip antenna have multi-band characteristics so that the multi-band characteristics are obtained both when said whip antenna is received in the radio device casing and expanded therefrom.

15. A telescopic multi-band whip antenna as claimed in claim 14, wherein said radio device casing is provided with a holder for fixing said small-size antenna, and said whip is provided at upper and lower end portions thereof with a first and a second stopper, respectively, which are held by said holder when said whip antenna is received in the radio device casing and expanded therefrom, said first and second stoppers being electrically insulated from said holder.

16. A telescopic multi-band whip antenna as claimed in claim 15, wherein said whip antenna is electrically separated from said small-size antenna by said first stopper when said whip antenna slides in said holder to be received in said radio device casing.

17. A telescopic multi-band whip antenna as claimed in claim 14, wherein said whip antenna comprises an LC parallel resonance circuit including a chip inductor and a chip capacitor, and a metal radiation element connected to said LC parallel resonance circuit.

18. A telescopic multi-band whip antenna as claimed in claim 17, wherein said metal radiation element is made of a Ti—Ni alloy.

19. A telescopic multi-band whip antenna as claimed in claim 14, wherein said whip antenna comprises a combination of a self-resonance chip inductor and a metal radiation element connected thereto.

20. A telescopic multi-band whip antenna as claimed in claim 19, wherein said metal radiation element is made of a Ti—Ni alloy.

21. A telescopic multi-band whip antenna as claimed in claim 14, wherein said whip antenna comprises a combination of a distributed constant parallel resonance circuit as an LC parallel resonance circuit, and a metal radiation element.

22. A telescopic multi-band whip antenna as claimed in claim 21, wherein said metal radiation element is made of a Ti—Ni alloy.

23. A telescopic multi-band whip antenna as claimed in claim 14, wherein said whip antenna comprises a combination of a self-resonance air-core coil as an LC parallel resonance circuit, and a metal radiation element.

24. A telescopic multi-band whip antenna as claimed in claim 23, wherein said metal radiation element is made of a Ti—Ni allow.

25. A telescopic multi-band whip antenna as claimed in claim 14, wherein said small-size antenna comprises a combination of an LC parallel resonance circuit having a chip inductor and a chip capacitor, and a helical coil connected thereto.

26. A telescopic multi-band whip antenna as claimed in claim 14, wherein said small-size antenna comprises a combination of a self-resonance chip inductor and a helical coil connected thereto.

27. A telescopic multi-band whip antenna as claimed in claim 14, wherein said small-size antenna comprises a combination of a self-resonance air-core coil and a helical coil connected thereto.

28. A telescopic multi-band whip antenna as claimed in claim 14, wherein said small-size antenna comprises a combination of an LC parallel resonance circuit including a chip inductor and a chip capacitor mounted on a flexible board, and a meander pattern formed on said flexible board.

29. A telescopic multi-band whip antenna as claimed in claim 14, wherein said small-size antenna comprises a combination of a self-resonance circuit having a chip inductor and working as an LC parallel resonance circuit, and a meander pattern, said self-resonance circuit and said meander pattern being provided on a flexible board.

30. A telescopic multi-band whip antenna as claimed in claim 14, wherein said small-size antenna comprises a combination of a self-resonance circuit having an air-core coil and working as an LC parallel resonance circuit, and a meander pattern, said self-resonance circuit and said meander pattern being provided on a flexible board.

31. A telescopic multi-band whip antenna as claimed in claim 14, wherein said small-size antenna comprises a combination of a distributed constant parallel resonance circuit and a meander pattern both provided on a flexible board.

32. A multi-band helical antenna comprising a plurality of helical coils, a plurality of helical guides around which said plurality of helical coils are wound, and a conductive holder holding said plurality of helical guides, wherein said plurality of helical coils have different diameters and different numbers of turns and are parallelly wound around said plurality of helical guides, said plurality of helical guides have different diameters and arranged concentrically and overlapped with each other, and power is fed from said holder to said plurality of helical coils, respectively, so as to obtain a plurality of resonance frequencies.

33. A telescopic whip antenna comprising a rod antenna which is receivable in a casing and expandable therefrom, and a small-size antenna provided at an upper portion of said rod antenna, wherein power is fed to said rod antenna upon expansion from said casing and to said small-size antenna when said rod antenna is received in said casing, wherein said small-size antenna comprises a board made of an insulating material having an electrode pattern formed thereon, and uses a resonance frequency based on a dielectric constant of said board and said electrode pattern, and wherein said board comprises a flexible board, said electrode pattern comprises a meander line pattern formed on said flexible board, and said flexible board is wound into a cylindrical shape and fixed.

34. A telescopic whip antenna comprising a rod antenna which is receivable in a casing and expandable therefrom, and a small-size antenna provided at an upper portion of said rod antenna, wherein power is fed to said rod antenna upon expansion from said casing and to said small-size antenna when said rod antenna is received in said casing, wherein said small-size antenna comprises a board made of an insulating material having an electrode pattern formed thereon. and uses a resonance frequency based on a dielectric constant of said board and said electrode pattern, and wherein said board comprises a flexible board, said electrode pattern comprises a sawtooth line pattern formed on said flexible board, and said flexible board is wound into a cylindrical shape and fixed.

35. A telescopic whip antenna comprising a rod antenna which is receivable in a casing and expandable therefrom, and a small-size antenna provided at an upper portion of said rod antenna, wherein power is fed to said rod antenna upon expansion from said casing and to said small-size antenna when said rod antenna is received in said casing, wherein said small-size antenna comprises a board made of an insulating material having an electrode pattern formed thereon, and uses a resonance frequency based on a dielectric constant of said board and said electrode pattern, and wherein said board formed is fixed by soldering or under pressure to a sleeve for feeding power to said small-size antenna when said rod antenna is received in said casing.

* * * * *